United States Patent [19]

Brenneman

[11] 4,412,439

[45] Nov. 1, 1983

[54] COOPERATIVE ROLLING MILL APPARATUS AND PROCESS

[75] Inventor: William L. Brenneman, Cheshire, Conn.

[73] Assignee: Olin Corporation, New Haven, Conn.

[21] Appl. No.: 260,491

[22] Filed: May 4, 1981

[51] Int. Cl.[3] ..... B21B 45/02

[52] U.S. Cl. ..... 72/41; 72/205; 72/236

[58] Field of Search ..... 72/41, 46, 205, 232, 72/236, 366

[56] References Cited

U.S. PATENT DOCUMENTS

| | | | |
|---|---|---|---|
| 2,291,361 | 7/1942 | Walsh | 148/4 |
| 2,316,067 | 4/1943 | Hickman | 72/161 |
| 2,332,796 | 10/1943 | Hume | 72/160 |
| 2,370,895 | 3/1945 | Wean | 72/161 |
| 2,392,323 | 1/1946 | Koss | 72/164 |
| 2,526,296 | 10/1950 | Stone | 72/164 |
| 3,238,756 | 3/1966 | Coffin, Jr. | 72/232 |
| 3,253,445 | 5/1966 | Franek | 72/164 |
| 3,332,292 | 7/1967 | Roberts | 72/8 |
| 3,377,830 | 4/1968 | Campbell | 72/205 |
| 3,394,574 | 7/1968 | Franek et al. | 72/205 |
| 3,527,078 | 9/1970 | Lawson et al. | 72/160 |
| 3,709,017 | 1/1973 | Vydrin et al. | 72/205 |
| 3,798,950 | 3/1974 | Franek et al. | 72/205 |
| 3,811,307 | 5/1974 | Vydrin et al. | 72/205 |
| 3,823,593 | 7/1974 | Vydrin et al. | 72/205 |
| 3,861,188 | 1/1975 | Kamit et al. | 72/234 |
| 3,871,221 | 3/1975 | Vydrin et al. | 72/205 |
| 3,911,713 | 10/1975 | Vydrin et al. | 72/205 |
| 4,244,203 | 1/1981 | Pryor et al. | 72/205 |
| 4,289,005 | 9/1981 | Cabaret et al. | 72/12 |
| 4,329,863 | 5/1982 | Pryor et al. | 72/205 |

FOREIGN PATENT DOCUMENTS

| | | |
|---|---|---|
| 443780 | 8/1970 | Australia . |
| 466254 | 3/1974 | Australia . |
| 691139 | 12/1965 | Belgium . |
| 363259 | 11/1922 | Fed. Rep. of Germany . |
| 1506671 | 11/1967 | France . |
| 1506680 | 11/1967 | France . |
| 2371246 | 11/1976 | France . |
| 54-5848 | 3/1979 | Japan . |
| 54-10258 | 3/1979 | Japan . |
| 1002936 | 9/1965 | United Kingdom . |
| 1086643 | 10/1967 | United Kingdom . |
| 1087097 | 10/1967 | United Kingdom . |
| 1117585 | 6/1968 | United Kingdom . |
| 1125554 | 8/1968 | United Kingdom . |
| 1219967 | 1/1971 | United Kingdom . |
| 1223188 | 2/1971 | United Kingdom . |
| 2004486 | 4/1979 | United Kingdom . |
| 259793 | 12/1969 | U.S.S.R. . |

OTHER PUBLICATIONS

"Status of Contact-Bend-Stretch Rolling", Coffin, Jr., Journal of Metals, Aug. 1967, pp. 16-22.

"Introduction to the Theory of Plasticity for Engineers", Hoffman & Sachs, McGraw-Hill, 1953, pp. 214-239.

"New Sheet Rolling Process from Russia", Machinery & Production Engineering, vol. 128, No. 3319, Jul. 21, 1976, Burgess Hill, Sussex, Gr. Br.

"Shear Rolling, A New Cold Rolling Method-Rolling Process and Rolling Mill Equipment", Hollmann et al., Stahl and Eisen, vol. 99, No. 6, Mar. 26, 1979, Dusseldorf, Germany.

*Primary Examiner*—Lowell A. Larson

*Attorney, Agent, or Firm*—Barry L. Kelmachter; Howard M. Cohn; Paul Weinstein

[57] ABSTRACT

This invention relates to a rolling mill apparatus and process which utilizes the creation of a differential friction force in at least the most downstream one of a plurality of roll bites for a variety of purposes. In a first embodiment, a differential friction force is created at the most downstream roll bite for reducing the maximum strip tension and forward strip tension thereby increasing the maximum attainable reduction in strip thickness per pass and reducing the size of the recoiler used for applying the forward tension. In a second embodiment, differential friction forces are created at the most upstream roll bite and the most downstream roll bite for increasing strip tension at all of the roll bites while decreasing the separating force required to obtain given strip reductions without increasing the maximum strip tension.

42 Claims, 8 Drawing Figures

COOPERATIVE ROLLING MILL APPARATUS AND PROCESS

This invention relates to a method and apparatus for utilizing the creation of a differential friction force in at least one roll bite of a rolling mill for a variety of purposes. The apparatus comprises a rolling mill for rolling strip under tension having a plurality of roll bites at which strip thickness is reduced. The invention may be used to reduce the maximum strip tension thereby increasing the maximum attainable reduction in strip thickness per pass and to reduce the forward strip tension thereby reducing the required recoiler size. The invention may also be used to increase strip tension in all of the roll bites so that the separating force required for given strip reductions is decreased without increasing the maximum strip tension. The invention is applicable to a wide range of metals and alloys which are capable of plastic deformation.

Conventionally, rolling mills are found with many different configurations including two high, four high, and cluster mills. With these conventional mills, the total reduction which can be achieved in the metal strip before annealing is required is determined by the roll separating force generated during the rolling operation. This separating force increases from pass to pass as the metal strip becomes work hardened until a maximum limit is reached for the mill. When the separating force reaches a sufficiently high level, roll flattening, mill elasticity and strip flow strength are in balance and the mill ceases to make any significant further reductions in the strip thickness. Normally, prior to the strip reaching such a separating force level, further rolling is uneconomic and the strip is annealed to make it softer and thereby reduce the separating force in the next pass through the mill.

It is desired that the present reduction in thickness per pass and the total reduction which can be taken in the strip by a rolling mill between anneals be as large as possible so as to reduce the need for costly and time consuming anneals. Various approaches have been described in the prior art for achieving such increases in available reduction in thickness between anneals. In most of these techniques, a stretching component has been added to the rolling reduction in order to provide increased percentages of reduction. To assist these techniques, some prior art approaches use a differential friction force or forces.

A method and apparatus for processing strip metal under tension utilizing rolls with roughened surfaces is disclosed in U.S. Pat. No. 2,526,296 to Stone. The rolls with roughened surfaces are primarily used to roughen the surface of the strip; however, the surface of a drag roll at the entry bite may be roughened to increase the friction between it and the strip to move the yield point line.

A second approach for rolling strip under tension makes use of lubricants to create conditions of differential friction forces at a reduction roll bite. Typical of such approaches are those exemplified by U.S. Pat. No. 3,332,292 to Roberts and U.K. patent application No. 2,004,486 to Vydrin.

An approach for rolling strip material under tension employing a mill with multiple roll bites is the cooperative rolling process and apparatus disclosed in U.S. Pat. No. 4,244,203 to Pryor et al. This approach passes the strip material through a mill in a serpentine arrangement to provide, for example, three reductions per pass. Forward and back tension are applied to the strip during rolling.

The difficulty with rolling strip material under tension is that the maximum reduction attainable per pass is limited by the tensile failure of the strip. By controlling the maximum strip tension, increased reduction per pass as well as other benefits can be achieved.

In accordance with this invention, an improved process and apparatus is provided for rolling metal strip. The approach in accordance with this invention makes use of the creation of a differential friction force at least one, but not all, reduction roll bites of a mill having a plurality of roll bites.

In accordance with this invention, the strip thickness can be reduced at a plurality of roll bites. In one embodiment of the invention, a differential friction force is created only at the most downstream roll bite to reduce the maximum strip tension and increase the maximum attainable reduction per pass. This approach provides additional benefits such as reduction of the forward longitudinal tensile force in the strip. A reduction in the forward tensile force means that a smaller recoiler can be used since a smaller forward tension is required.

In a second embodiment of the invention, a differential friction force is simultaneously created at the most upstream and the most downstream roll bites. This approach enables the strip tension at all of the roll bites to be increased so that the required separating force for given strip reductions can be decreased without an increase in the maximum strip tension.

Accordingly, it is an object of the invention to provide an improved process and apparatus for rolling metal strip.

It is a further object of this invention to provide a process and apparatus for controlling the maximum strip tension.

It is a further object of this invention to provide a process and apparatus as above for increasing the maximum attainable rolling reduction per pass.

It is a further object of this invention to provide a process and apparatus for increasing strip tension at all of the reduction roll bites so that the required separating force for a given strip reduction can be decreased without an increase in the maximum strip tension.

These and other objects will become more apparent from the following description and drawings, wherein like numerals depict like parts.

In accordance with this invention, an apparatus and process for increasing the reduction in thickness of a metal strip per pass is provided. The disclosed apparatus and process can be used to reduce the maximum strip tension thereby increasing the maximum attainable reduction of the strip per pass. The disclosed apparatus and process can also be used to increase the strip tension at all of the reduction roll bites so that the separating force required to obtain a given strip reduction can be reduced without increasing the maximum strip tension.

The apparatus and process of the instant invention is particularly adaptable for use with a cooperative rolling system of the type described in the Pryor et al. patent and will be described as part of such a system. However, the apparatus and process of the instant invention could be adapted to other types of rolling systems.

Figure 1:
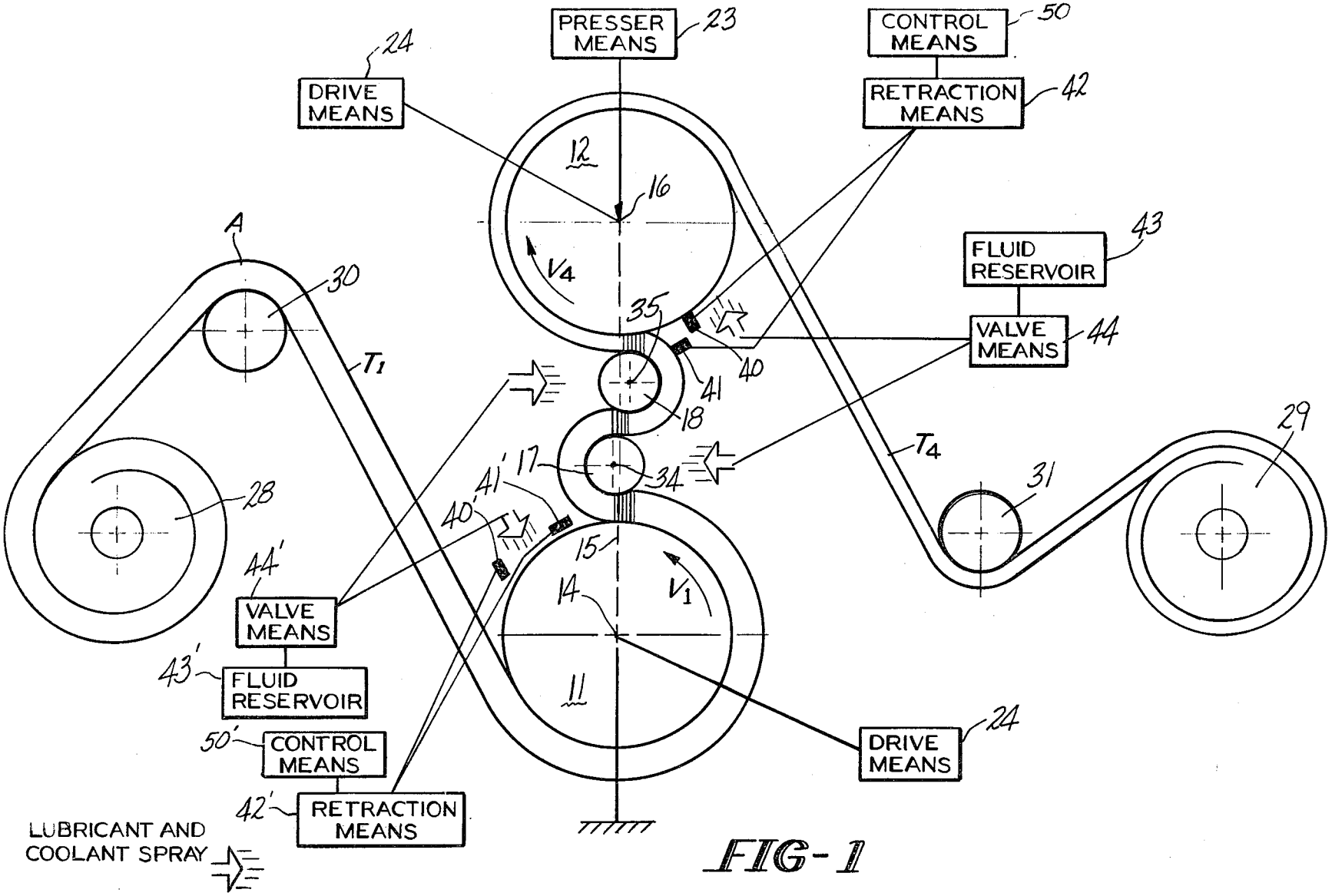
FIG. 1 is a schematic illustration of a side view of an apparatus in accordance with one embodiment of this invention.
Figure 3:
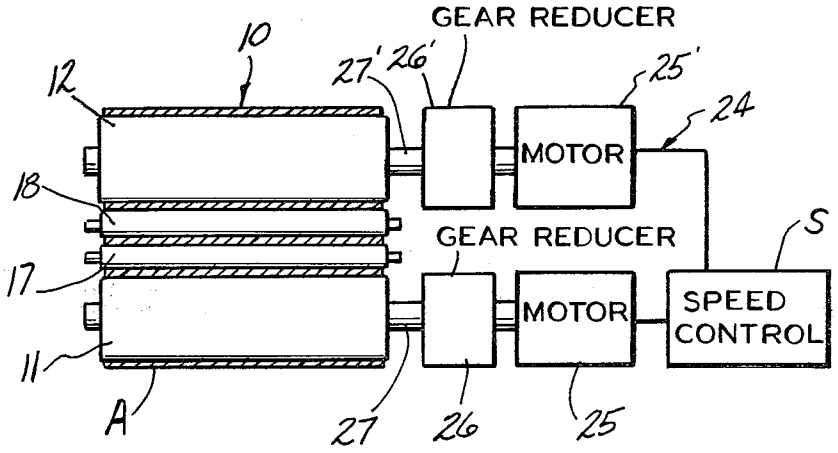
FIG. 3 is a partial view showing the drives to the rolls of the apparatus of FIG. 1.
Figure 2:
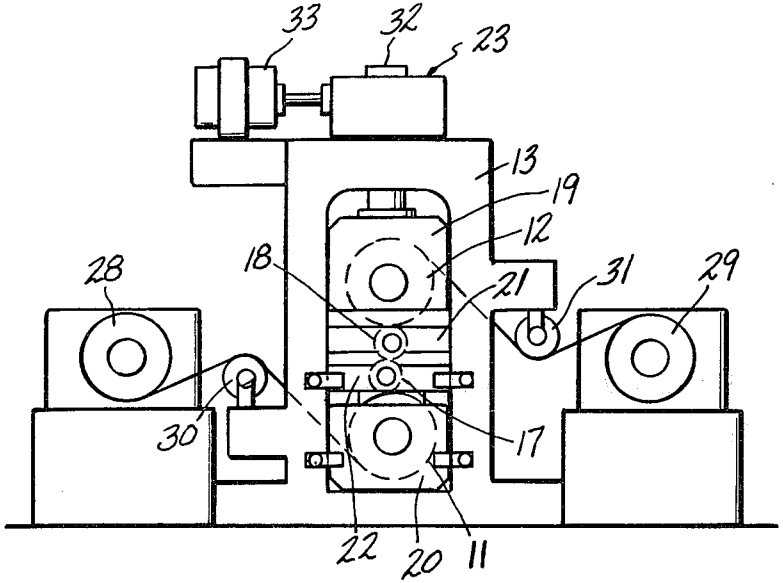
FIG. 2 is a more detailed illustration of the apparatus of FIG. 1.

Referring now to FIGS. 1–3, there is shown by way of example a cooperative rolling mill 10 in accordance with a preferred embodiment of the present invention. The cooperative rolling mill 10 comprises first 11 and second 12 back-up rolls of relatively large diameter. The lower back-up roll 11 is journaled for rotation in the machine frame 13 of the rolling mill about a fixed horizontal roll axis 14. The upper back-up roll 12 is journaled for rotation in the machine frame 13 about roll axis 16 and is arranged for relative movement toward and away from the lower back-up roll 11 along the vertical plane 15 defined by the back-up roll axes 14 and 16. Arranged between the upper 12 and lower 11 back-up rolls are two free wheeling work rolls 17 and 18 having a diameter substantially smaller than the diameter of the back-up rolls 11 and 12. The work rolls 17 and 18 are journaled for rotation and arranged to idle in the machine frame 13. They are adapted to float in a vertical direction along the plane 15. The specific support mechanisms 19, 20, 21, and 22, etc. for the respective rolls 11, 12, 17, and 18 of the mill 10 may have any desired structure in accordance with conventional practice.

A motor driven screw down presser means 23 of conventional design is utilized to provide a desired compressive force between the back-up rolls 11 and 12 and their cooperating work rolls 17 and 18 and between the work rolls themselves.

The speed relationship between the lower back-up roll 11 and the upper back-up roll 12 is such that the peripheral speed of the lower back-up roll $V_1$ is less than the peripheral speed $V_4$ of the upper back-up roll 12. This can be accomplished relatively easily by a two motor drive 24 as in FIG. 3 which will drive the upper back-up roll 12 at a higher speed relative to the lower back-up roll 11 in proportion to the desired reduction in thickness of the strip A passing through the mill. The back-up rolls 11 and 12 are driven by motors 25 and 25' which are connected to the rolls 11 and 12 through reduction gear boxes 26 and 26' and drive spindles 27 and 27'. A speed control S is connected to the motors 25 and 25' in order to drive the rolls 11 and 12 at the desired speed ratio. The particular drive system 24 which has been described above does not form part of the present invention, and any desired drive system for driving the rolls 11 and 12 at the desired peripheral speed ratio could be employed. The drive to the work rolls 17 and 18 is provided by the back-up rolls 11 and 12 acting through the encompassing strip A.

The strip A is strung or threaded as shown in FIG. 1 whereby the incoming strip is wrapped around the slower moving back-up roll 11 and then forms an "S" shaped bridle around the work rolls 17 and 18 and finally exits by encompassing the fast moving back-up roll 12. In this manner three reductions as shown in FIG. 1 are taken in the strip A as it passes through the mill 10. The first reduction is between the slow moving lower back-up roll 11 and its cooperating lower work roll 17. The second reduction is between the lower and upper work rolls 17 and 18. The third reduction is between the upper work roll 18 and its cooperating fast moving upper back-up roll 12. Forward and back tensions $T_4$ and $T_1$ are applied to the strip A in a conventional manner by any desired means such as the coilers/decoilers 28 and 29. Billy rolls 30 and 31 arranged as shown are used to redirect strip A direction to provide the desired wrapping about the back-up rolls 11 and 12.

The strip A encompasses each of the work rolls 17 and 18 through about 180° of the circumference of the rolls. In the embodiment shown, the strip A encompasses each of the back-up rolls 11 and 12 to a greater extent, namely about 270°. As shown in FIG. 1, coolant and lubricant may be selectively applied to the back-up rolls 11 and 12 and work rolls 17 and 18. The specific apparatus for applying the coolant and lubricant may be of any desired conventional design as are known in the art.

In operation the strip A is threaded through the mill 10 in the manner shown in FIG. 1 and suitable forward and back tensions $T_4$ and $T_1$ are applied to the leading and trailing portions of the strip A by means of the coilers/decoilers 28 and 29. The presser means 23 which may be of any conventional design and which may be hydraulically actuated (not shown) or screw 32 actuated through a suitable motor drive 33 is operated to apply a desired and essential operating pressure or compressive force between the respective rolls 11, 12, 17 and 18. The tensions $T_1$ and $T_4$ applied to the strip A preferably should be sufficient to prevent slippage between the rolls 11, 12, 17 and 18 and the strip A. The motor 25 is energized to advance the strip A through the mill 10 by imparting drive to the back-up rolls 11 and 12 which in turn drive the idling work rolls 17 and 18 through the strip A. The upper back-up roll 12 and the work rolls 17 and 18 may be arranged for floating movement vertically along the plane 15. In one embodiment not shown, the roll axes 14, 16, 34 or 35 of each of the back-up rolls 11 and 12 and work rolls 17 and 18 all lie in the single vertical plane 15. In the preferred embodiment, however, to attain greater stability for the work rolls 17 and 18, the plane defined by the axes 34 and 35 of the work rolls 17 and 18 can be tilted very slightly with respect to the plane 15 defined by the axes 14 and 16 of the back-up rolls 11 and 12. Any suitable tilt angle as known in the art may be defined between the plane of the work rolls 17 and 18 and the plane of the back-up rolls 11 and 12. The plane of the work rolls 17 and 18 when tilted should preferably be tilted in a direction to further deflect the strip A, namely clockwise as viewed in FIG. 1. However, it may not be essential in accordance with this invention that the plane of the work rolls 17 and 18 be tilted with respect to the plane 15 of the back-up rolls 11 and 12 and such an expedient is preferably employed when it is necessary to provide stabilization of the work rolls 17 and 18.

In operation, the driven upper back-up roll 12 should be driven at a peripheral speed consistent with the final desired gage of the strip A. Accordingly, it will be rotating at a peripheral speed $V_4$ relative to the speed $V_1$ of the lower back-up roll 11 which is proportional to the total reduction which is to be done in the roll stand.

When the mill 10 is powered up and put under reasonable separating force by the presser means 23, the three reduction points as shown in FIG. 1 are attained. Each of these reduction points comprises the roll bite between a pair of rolls. The first reduction point is the most upstream roll bite between the lower driven slow back-up roll 11 and the lower free wheeling work roll 17. The second reduction point is the roll bite between the lower and upper free wheeling work rolls 17 and 18. The third reduction point is the most downstream roll bite between the upper work roll 18 and the upper driven back-up roll 12.

Figure 6:
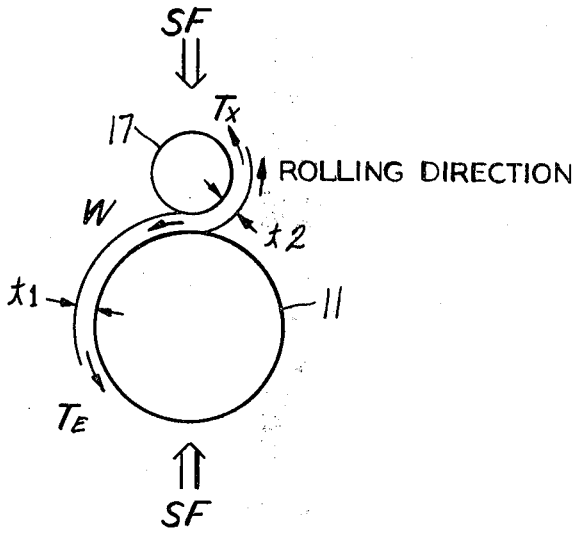
FIG. 6 is a schematic illustration of the forces operating at a roll bite for the cooperative rolling process.

The force components believed to be developed in an individual roll bite for the above-described process are illustrated in FIG. 6. The strip entering the roll bite has a thickness $t_1$ while the strip exiting the roll bite has a thickness $t_2$. The difference $\Delta t$ between $t_1$ and $t_2$ is the reduction. The strip tension $T_x$ at the exit to the roll bite exceeds the strip tension $T_E$ at the entry to the roll bite by the roll bite wedge force W. The roll bite edge force W is believed to be a function of the separating force SF and the reduction $\Delta t$. It is believed that the wedge force W ordinarily increases with increasing separating force SF and reduction $\Delta t$.

Figure 7:
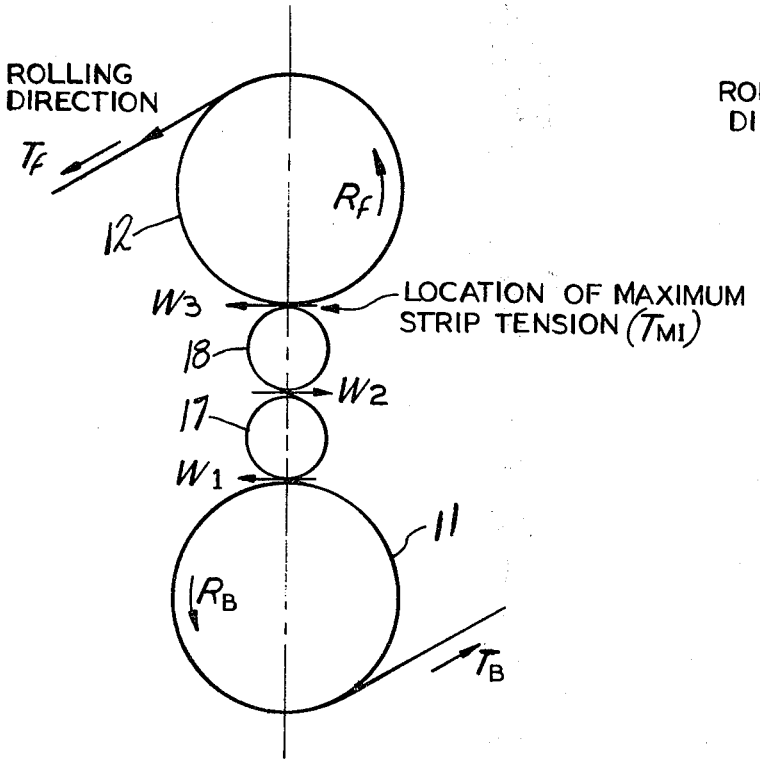
FIG. 7 is a schematic illustration of the longitudinal forces acting on the strip for the cooperative rolling process.

The longitudinal forces believed to be exerted on the strip as it passes through a typical cooperative rolling mill are illustrated in FIG. 7. In this figure, it is assumed that the friction properties of all rolls are identical. The forward tension is designated $T_F$ and the wrap force on the upper driven back-up roll is $R_F$. The back tension is designated $T_B$ and the wrap force on the lower driven back-up roll is $R_B$. A wedge force $W_1$, $W_2$, $W_3$ is produced at each roll bite. The maximum strip tension force $T_{MI}$ on the strip A is believed to be defined in accordance with the following equation:

$$T_{MI}=T_B+R_B+W_1+W_2+W_3 \quad (1)$$

It is believed that as the reduction in thickness of the strip A increases, so do the wedge forces $W_1$, $W_2$, $W_3$. When the maximum strip tension force $T_{MI}$ exceeds the strip's tensile strength, the strip breaks thus setting the upper limit on the attainable reduction for each pass.

By reducing the maximum strip tension force, it is believed that larger reductions per pass and other benefits can be attained. The strip tension exit force $T_x$ is believed to be a function of the frictional relationships between each roll of the roll bite and the strip A. The roll bite friction force f for each roll can be considered to be equal to the product of the roll bite coefficient of friction $\mu$ and the roll separation force SF, that is, $$f=\mu SF \quad (2)$$

A difference in the coefficient of friction of each roll forming a roll bite could be used to create a differential friction force. This differential friction force can be designed to act in opposition to the wedge force at the roll bite so that the effective wedge force at the roll bite is substantially eliminated. In a preferred manner, this is accomplished by having one roll of the roll bite exert a larger roll bite friction force $f_1$ on strip A than the friction force $f_2$ exerted by the other roll of the roll bite on strip A. Since these roll bite friction forces act in opposite directions, a differential friction force $\Delta f$, which can provide a net reduction in strip tension, is created and is equal to $f_1-f_2$. It is believed that such a modification to the roll bite friction forces reduces the longitudinal tensile force in the strip without the development of a friction hill.

FIG. 1 demonstrates one manner of utilizing the creation of a differential friction force. As previously stated, the maximum reduction attainable per pass is limited by tensile failure of the strip. As the strip proceeds through the roll bites, the tensile stress on the strip increases due to the force required to pull the strip through each roll bite wedge and the reduction in the strip's cross sectional area. With increasing gage reduction, it is believed that the wedge forces become larger until the strip fails in tension. In the cooperative rolling process, when strip failure occurs, it nearly always occurs at the exit to the third or most downstream roll bite where strip tension is the highest and the cross-sectional area the smallest. In order to reduce the maximum strip tension and increase the maximum attainable reduction, it is preferred that a differential friction force be created at the most downstream roll bite.

When mill 10 and consequently strip A are driven as shown in FIG. 1, an abundant amount of coolant and lubricant from reservoir 43' may be applied to lower back-up roll 11 and work roll 18 via valve means 44'. Likewise, an abundant amount of coolant and lubricant from reservoir 43 may be applied to work roll 17 via valve means 44. Valve means 44 is preferably operated so that no coolant and lubricant is applied to upper back-up roll 12. In this manner, coolant and lubricant is applied to the surfaces of strip A as well as rolls 11, 17 and 18. The coolant and lubricant is utilized primarily to dissipate heat from the work rolls. When mill 10 is used as a reversing mill and strip A is driven in a direction opposite to that shown in FIG. 1, coolant and lubricant from reservoir 43 may be applied to back-up roll 12 and work roll 17 via valve means 44 and coolant and lubricant from reservoir 43' may be applied to work roll 18 via valve means 44'. Valve means 44' may be operated so that no coolant and lubricant is applied to back-up roll 11. If desired, reservoirs 43 and 43' may be combined into a single fluid reservoir connected to valve means 44 and 44'. Any suitable valving arrangement as known in the art may be used for valve means 44 and 44'.

In order to create the desired differential friction force, preferably at the most downstream roll bite, the volume of lubricant entering opposite sides of the roll bite should be controlled. This is done in a preferred manner by utilizing wipes 40 and 41 or wipes 40' and 41', depending upon the direction in which mill 10 is being driven. When mill 10 is driven in the direction shown in FIG. 1, wipes 40 and 41 contact the surface of back-up roll 12 and the surface of strip A contacting back-up roll 12, respectively. Wipes 40' and 41' are held in a retracted position away from back-up roll 11 and strip A by retraction means 42'. When mill 10 is driven in the direction opposite that shown in FIG. 1, wipes 40 and 41 may be held in a retracted position away from back-up roll 12 and strip A by retraction means 42 and wipes 40' and 41' may be placed in contact with back-up roll 11 and the surface of strip A contacting roll 11. Retraction means 42 and 42' may be formed by any suitable mechanism, such as a hydraulic cylinder or a solenoid device, having any suitable control means 50 and 50' for moving wipes 40, 40', 41 and 41' into and out of contact with the respective back-up rolls and surfaces of strip A.

Wipes 40, 40', 41 and 41' are each preferably formed by a permeable membrane impregnated with a solvent. Preferably, wipes 40, 40', 41 and 41' comprise a felt strip impregnated with kerosene; however, any suitable permeable membrane and any suitable solvent may be used. Alternatively, any suitable mechanism for removing coolant and lubricant can be employed. When mill 10 is used as a reversing mill, it is preferred that wipes 40, 40', 41 and 41' be used to create the differential friction force since they may be easily moved into and out of contact with the back-up rolls 11 and 12 and surfaces of strip A.

Figure 8:
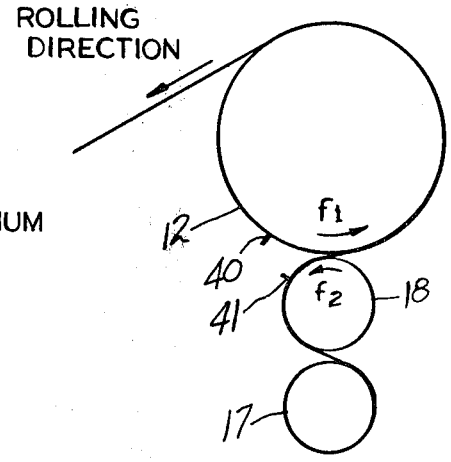
FIG. 8 is a schematic illustration of the technique for using differential roll bite frictions in a roll bite to reduce the longitudinal tensile force on the strip.

By removing the lubricant from the upper back-up roll 12 surface and from the surface of strip A contacting the upper back-up roll 12 as shown in FIG. 1, a greater coefficient of friction exists between strip A and back-up roll 12 than between strip A and work roll 18. As a result, upper back-up roll 12 has a larger friction force $f_1$ associated with it than the friction force $f_2$ associated with roll 18. As shown in FIG. 8, $f_1$ and $f_2$ act in different directions. The differential friction force $\Delta_f$ equals $f_1-f_2$ and acts in a direction opposite to the wedge force $W_3$ at the most downstream roll bite. This reduces the effective wedge force and consequently, both the maximum strip tension $T_{MI}$ and the forward longitudinal tensile force. This reduction in maximum strip tension $T_{MI}$ and longitudinal tensile force has several benefits. First, the cooperative rolling mill can attain a greater reduction in strip thickness. Second, since the forward tension force on the strip is reduced, a smaller recoiler can be used. Third, the reduction in forward tension force reduces the tightness of the coil formed on the recoiler which assists in subsequent anneals performed on the coiled strip. When mill 10 is operated as a reversing mill and strip strip A is driven in a direction opposite from that shown in FIG. 1, lubricant may be removed from the lower back-up roll 11 surface and from the surface of strip A contacting the lower back-up roll 11 to create the differential friction force at the most downstream roll bite of that configuration by applying wipes 40' and 41' as previously discussed.

Figure 5:
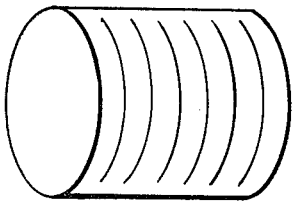
FIG. 5 is a schematic illustration of a back-up roll having a roughened surface.

When mill 10 is operated as a non-reversing mill, in lieu of wipes 40, 40', 41 and 41' and their respective retraction means, back-up roll 12 may be provided with a roughened surface such as that shown in FIG. 5. The roughened roll surface should be such as to create the appropriate differential friction force $\Delta_f$ but should not be such as to have any detrimental effects on the desired surface quality of the strip. The use of a back-up roll 12 with a roughened surface is desirable in a non-reversing mill since it is simpler and a more permanent arrangement which requires less maintenance.

Figure 4:
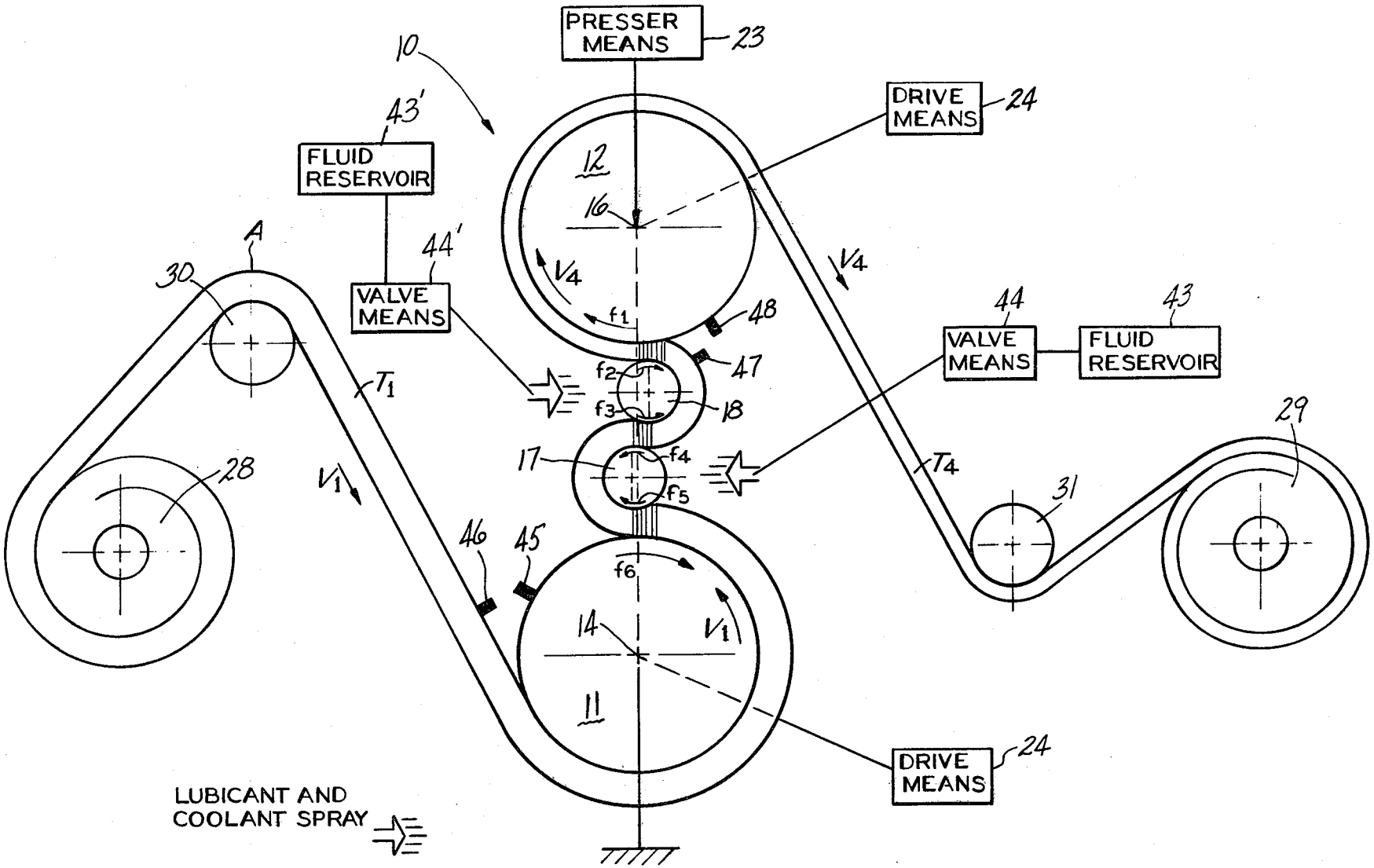
FIG. 4 is a schematic illustration of a side view of an apparatus in accordance with a second embodiment of this invention.

Another manner of using a differential friction force or forces is demonstrated in the embodiment of FIG. 4. In this embodiment, it is desired that the friction forces $f_1$ and $f_6$ generated by the back-up rolls 12 and 11, respectively, be higher than the friction forces $f_2$, $f_3$, $f_4$, $f_5$ generated by the work rolls 17 and 18. Preferably, the friction forces $f_1$ and $f_6$ are substantially equal to each other and created in opposite directions. In this fashion, both the front tension force and the back tension force on the strip may be increased. As a result, it is believed that the strip tension at all three roll bites is increased. When the strip tensions are increased, the compressive force needed to cause material flow to get a desired thickness reduction is reduced. In this case, this means that the required separating force is decreased. Since the tension added by the entry or lower back-up roll 11 effectively cancels the tension added by the exit or upper back-up roll 12, there is no increase in the maximum strip tension. Were the back tension $T_B$ increased to reduce the required separating force SF while having all the friction forces $f_1$–$f_6$ equal, it is believed that the maximum strip tension would increase.

By increasing the coefficient of friction between the lower and upper back-up rolls 11 and 12 and the strip A, it is believed that the range of the separating force required to obtain a desired reduction is enlarged. Additionally, it is believed that a larger maximum allowable wrap force may be possible. The maximum allowable wrap force $W_{max}$ on the entry back-up roll is believed to be defined by the following equation:

$$W_{max}=T_B(e^{\mu\theta}-1) \quad (3)$$

where $T_B$=back or decoiler tension $\mu$=coefficient of friction between entry back-up roll and strip A on the roll circumference $\theta$=angle of wrap between strip A and the entry back-up roll A larger wrap force is believed to encourage the strip to move at the speed of the back-up rolls 11 and 12. As a result, a more stable rolling process would be possible.

In the embodiment of FIG. 4, wipes 45, 46, 47, and 48 are provided as shown. Wipe 45 is used to remove coolant and lubricant from the surface of lower back-up roll 11. Wipe 46 may be used to remove any coolant or lubricant from the surface of strip A contacting lower back-up roll 11. Coolant and lubricant from reservoirs 43 and 43' is applied to work rolls 17 and 18, respectively, via valve means 44 and 44'. Preferably, no coolant is applied to rolls 11 and 12. As a result, friction forces $f_2$, $f_3$, $f_4$, and $f_5$ are substantially equal. Wipe 47 is used to remove coolant and lubricant from the surface of strip A which contacts the surface of upper back-up roll 12. Wipe 48 removes any coolant and lubricant from the surface of upper back-roll 12. Wipes 45–48 each preferably comprise a permeable membrane impregnated with a solvent. In a preferred embodiment, wipes 45–48 are formed by a felt strip impregnated with kerosene; however, any suitable mechanism for removing lubricant can be used. If desired, wipes 45–48 may be connected to retraction means (not shown) to move a selective one or ones of them out of contact with its respective back-up roll or rolls or strip surface.

By removing coolant and lubricant from upper and lower back-up rolls 11 and 12 and the surfaces of strip A contacting them, as shown in FIG. 4, $f_1$ and $f_6$ will be higher than $f_2$, $f_3$, $f_4$, $f_5$. Coolant and lubricant removal should be such that $f_1$ substantially equals $f_6$. In this manner, the previously stated objectives of increased strip tension at all roll bites, reduced required separating force and no increase in maximum strip tension will be achieved.

In lieu of wipes 43, 44, 45, and 46, each of the back-up rolls 11 and 12 could have a roughened surface such as that shown in FIG. 5 since it is desired that a differential friction force be created at both the most upstream and the most downstream of roll bite of the mill 10.

It is believed that the invention described herein is widely applicable to the rolling of stainless steel, copper, copper base alloys, iron and iron alloys, nickel and nickel alloys, aluminum and aluminum alloys as well as any other metal or alloy susceptible of plastic deformation.

While the instant invention has been described with respect to a cooperative rolling apparatus and process, it is applicable to other types of rolling apparatuses and processes where the mill has multiple roll bites.

While two alternatives for creating a differential friction force in a roll bite have been described, any suitable mechanism for creating a differential friction force or forces may be utilized. The word "strip" as used herein is intended to include wires, tubes, rods, and any other continuous material having any suitable cross-sectional shape.

The patents set forth in the background of this application are intended to be incorporated by reference herein.

It is apparent that there has been provided in accordance with this invention a rolling mill apparatus and process which fully satisifies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A rolling mill apparatus for reducing metal or metal alloy strip thickness comprising:

a plurality of roll bites, each of said roll bites causing a reduction in said strip thickness as said strip passes through said mill;

each said roll bite being formed by adjacent rolls between which said strip passes, each said roll having a coefficient of friction;

means for providing a forward tension to said strip as said strip passes through said mill; and means for creating a first differential friction force between at least said adjacent rolls of a most downstream one of said roll bites, but not between said adjacent rolls of at least one other of said roll bites, for causing a reduction in said forward tension, said differential friction force means including means for changing the coefficient of friction between a first of said adjacent rolls of said most downstream roll bite and said strip.

2. The rolling mill apparatus of claim 1 further comprising:

said strip having a yield strength;

said strip having a maximum strip tension exerted thereon;

said yield strength and said maximum strip tension determining a maximum attainable strip reduction; and wherein said first differential friction force creating means causes a reduction in said maximum strip tension and an increase in said maximum attainable reduction per pass;

whereby the size of said forward tension providing means can be minimized.

3. The rolling mill apparatus of claim 2 further comprising:

means for selectively applying coolant and lubricant to said strip and a second of said adjacent rolls of said most downstream roll bite;

at least a portion of said coolant and lubricant coming into contact with said first roll; and said coefficient of friction changing means comprising first means for removing at least part of said coolant and lubricant from said first roll and from a surface of said strip contacting said first roll.

4. The rolling mill apparatus of claim 3 wherein: said first removing means comprises first means for wiping a surface of said first roll and said surface of said strip contacting said first roll.

5. The rolling mill apparatus of claim 4 wherein: said wiping means comprises at least one permeable means for applying a solvent to said surfaces.

6. The rolling mill apparatus of claim 5 wherein: said at least one permeable means comprises at least one felt strip impregnated with kerosene.

7. The rolling mill apparatus of claim 4 further comprising: first means for retracting said first wiping means into a retracted position out of contact with said surfaces.

8. The rolling mill apparatus of claim 7 further comprising:

a reversible rolling mill having two strip rolling directions;

said first and second adjacent rolls forming said most downstream roll bite when said strip is rolled in a first of said rolling directions;

said coolant and lubricant applying means causing said coolant and lubricant to come into contact with a second roll bite;

said coefficient of friction changing means further comprising a second means for wiping a surface of a third one of said adjacent rolls forming said second roll bite and a surface of said strip contacting said third adjacent roll surface, said second roll bite forming said most downstream roll bite when said strip is rolled in a second of said rolling directions;

means for retracting said second wiping means into a retracted position out of contact with said third adjacent roll surface and said strip surface contacting said third adjacent roll surface; and means for controlling said retracting means so that when said strip is being rolled in said first rolling direction said first wiping means is in a contacting position and said second wiping means is in said retracted position and when said strip is being rolled in said second rolling direction said first wiping means is in said retracted position and said second wiping means is in a contacting position.

9. The rolling mill apparatus of claim 2 further comprising:

a rolling mill having at least two back-up rolls and at least two work rolls forming said plurality of roll bites; and said most downstream roll bite being formed by a most downstream one of said back-up rolls and a most downstream one of said work rolls.

10. The rolling mill apparatus of claim 1 wherein:

said differential friction force creating means comprises means for creating said differential friction force only at said most downstream roll bite.

11. A rolling mill apparatus for reducing metal or metal alloy strip thickness comprising:

a plurality of roll bites, each of said roll bites causing a reduction in said strip thickness as said strip passes through said mill;

each said roll bite being formed by adjacent rolls between which said strip passes, each said roll having a coefficient of friction;

means for applying tension to said strip;

means for applying a separating force to obtain said strip reduction;

said strip having a maximum strip tension exerted thereon; and means for creating differential friction forces for causing an increase in said strip tension at all of said roll bites and a reduction in said separating force required for a given strip reduction without increasing said maximum strip tension, said friction force creating means comprising means for creating a first differential friction force between said adjacent rolls of a most downstream one of said roll bites and a second differential friction force between said adjacent rolls of a most upstream one of said roll bites but not between said adjacent rolls of at least one other of said roll bites.

12. The rolling mill apparatus of claim 11 wherein: said second differential friction force creating means provides a friction force substantially equal to and acting in an opposite direction from said first differential friction force.

13. The rolling mill apparatus of claim 13 further comprising:

said strip being wrapped about a most upstream roll of said most upstream roll bite; and wherein said second differential friction force creating means increases a maximum allowable wrap force between said strip and said most upstream roll.

14. The rolling mill apparatus of claim 11 further comprising:

each said roll having a coefficient of friction;

said first differential friction force creating means comprising means for changing the coefficient of friction between a first of said adjacent rolls forming said most downstream roll bite and said strip; and said second differential friction force creating means comprising means for changing the coefficient of friction between a third of said adjacent rolls forming said most upstream roll bite and said strip.

15. The rolling mill apparatus of claim 14 further comprising:

means for selectively applying coolant and lubricant to at least said strip;

at least part of said coolant and lubricant contacting said first and third rolls; and said coefficient of friction changing means comprising means for removing at least part of said coolant and lubricant from said first and third rolls and from surfaces of said strip contacting said first and third rolls.

16. The rolling mill apparatus of claim 15 wherein: said removing means comprises first means for wiping a surface of said third roll and said surface contacting said third roll and second means for wiping a surface of said first roll and said surface contacting said first roll.

17. The rolling mill apparatus of claim 16 wherein: said first and second wiping means each comprise at least one permeable means for applying a solvent to said surfaces.

18. The rolling mill apparatus of claim 17 wherein: each said at least one permeable means comprises at least one felt strip impregnated with kerosene.

19. The rolliing mill apparatus of claim 14 further comprising:

said rolling mill apparatus having at least two back-up rolls and at least two work rolls forming said plurality of roll bites;

said most upstream roll bite being formed by one of said back-up rolls and one of said work rolls; and said most downstream roll bite being formed by a second one of said back-up rolls and a second one of said work rolls.

20. A process for rolling metal or metal alloy strip and reducing strip thickness comprising:

providing a rolling mill having a plurality of roll bites formed by a plurality of adjacent rolls between which said strip passes, each said roll having a coefficient of friction;

providing forward tensioning means;

applying a forward tension to said strip with said forward tensioning means;

passing said strip between said adjacent rolls for causing a reduction in said strip thickness at each of said roll bites as said strip passes through said mill; and creating a first differential force between at least said adjacent rolls of a most downstream one of said roll bites, but not between said adjacent rolls of at least one other of said roll bites, for causing a reduction in said forward tension so that the size of said forward tensioning means can be minimized, said step of creating a first differential friction force comprising changing the coefficient of friction between a first of said adjacent rolls of said most downstream roll bite and said strip.

21. The process of claim 20 further comprising:

said strip having a yield strength;

said strip having a maximum strip tension exerted thereon, said yield strength and said maximum strip tension determining a maximum attainable strip reduction; and wherein said step of creating a first differential friction force causes a reduction in said maximum strip tension and an increase in said maximum attainable strip reduction per pass.

22. The process of claim 21 further comprising:

selectively applying coolant and lubricant to said strip and a second of said adjacent rolls of said most downstream roll bite, at least a portion of said coolant and lubricant coming into contact with said first roll; and said step of the coefficient of friction comprising removing at least part of said coolant and lubricant from said first roll and from a surface of said strip contacting said first roll.

23. The process of claim 22 further comprising:

providing first means for contacting a surface of said first roll and said surface of said strip contacting said first roll; and said step of removing comprising wiping said surfaces with said contacting means.

24. The process of claim 23 wherein:

said step of providing contacting means comprises providing at least one permeable means; and said step of wiping comprises applying a solvent to said surfaces with said at least one permeable means.

25. The process of claim 24 wherein:

said step of providing at least one permeable means comprises providing at least one felt strip; and said step of applying solvent comprises impregnating said at least one felt strip with kerosene.

26. The process of claim 23 further comprising:

providing first means for retracting said first contacting means.

27. The process of claim 26 further comprising:

said step of providing a rolling mill comprising providing a reversible rolling mill having two strip rolling directions;

rolling said strip in a first of said rolling direction so that said first and second rolls form said most downstream roll bite;

rolling said strip in a second of said rolling directions so that a second roll bite forms said most downstream roll bite;

said step of applying coolant and lubricant causing at least a portion of said coolant and lubricant to come into contact with a third one of said adjacent rolls, said third roll forming part of said second roll bite;

said coefficient of friction change step further comprising providing second contacting means for wiping a surface of said third roll and a surface of said strip contacting said third roll surface;

providing second means for retracting said second contacting means into a retracted position when said strip is being rolled in said first direction; and controlling said first and second retracting means so that when said strip is being rolled in said first rolling direction said first contacting means being in said contacting position and said second contacting means being in said retracted position and when said strip is being rolled in said second rolling direction said first contacting means being in said retracted position and said second contacting means being in a contacting position.

28. The process of claim 25 wherein:

said step of providing a rolling mill comprises providing rolling mill apparatus having at least two back-up rolls and at least two work rolls forming said plurality of roll bites; and forming said most downstream roll bite by a most downstream one of said back-up rolls and a most downstream one of said work rolls.

29. The process of claim 24 wherein said step of creating said differential friction force comprises:

creating said differential friction force only at said most downstream roll bite.

30. A process for rolling metal and metal alloy strip and reducing strip thickness comprising:

providing a rolling mill having a plurality of roll bites formed by a plurality of adjacent rolls between which said strip passes, each said roll having a coefficient of friction;

applying tension to said strip and passing said strip through each of said roll bites wherein said strip has a maximum strip tension exerted thereon;

applying a separating force to said plurality of rolls forming said roll bites for obtaining said reduction in said strip thickness at each of said roll bites; and creating differential friction forces for causing an increase in said strip tension at all of said roll bites and a reduction in said separating force required for a given strip reduction without increasing said maximum strip tension, said differential friction force creating step comprising creating a first differential force between said adjacent rolls of a most downstream one of said roll bites and creating a second differential force between adjacent rolls of a most upstream one of said roll bites without creating a differential force between said adjacent rolls of at least one other of said roll bites.

31. The process of claim 36 wherein said step of creating said second differential friction force comprises:

providing a friction force substantially equal to and acting in an opposite direction from said first differential friction force.

32. The process of claim 36 further comprising:

wrapping said strip about a most upstream roll of said most upstream roll bite; and wherein said step of creating said second differential friction force increases a maximum allowable wrap force between said strip and said most upstream roll.

33. The process of claim 30 further comprising:

said step of creating said first differential friction force comprising changing the coefficient of friction between a first of said adjacent rolls forming said most downstream roll bite and said strip; and said step of creating said second differential force comprising changing the coefficient of friction between a third of said adjacent rolls forming said most upstream roll bite and said strip.

34. The process of claim 33 further comprising:

selectively applying coolant and lubricant to at least said strip, at least some of said coolant and lubricant contacting said first and third rolls; and said step of changing the coefficient of friction comprising removing at least part of said coolant and lubricant from said first and third rolls and from surfaces of said strip contacting said first and third rolls.

35. The process of claim 34 wherein: said step of removing coolant and lubricant comprising wiping surfaces of said first and third rolls and said strip surfaces contacting said first and third rolls.

36. The process of claim 35 further comprising:

providing at least one permeable means; and said step of wiping comprising applying a solvent to said surfaces with said at least one permeable means.

37. The process of claim 36 wherein:

said step of providing at least one permeable means comprises providing at least one felt strip; and said step of applying said solvent to surfaces comprises impregnating said at least one felt strip with kerosene.

38. The process of claim 33 further comprising:

said step of providing a rolling mill comprising providing a rolling mill apparatus having at least two back-up rolls and at least two work rolls forming said plurality of roll bites;

forming said most upstream roll bite with one of said back-up rolls and one of said work rolls; and forming said most downstream roll bite with a second one of said back-up rolls and a second one of said work rolls.

39. A four-high rolling mill apparatus for reducing metal or metal alloy strip thickness comprising:

means for providing a forward tension to said strip;

a plurality of rolls forming a plurality of roll bites, each said roll bite being formed by adjacent ones of said rolls and causing a reduction in said strip thickness per pass through said mill;

said plurality of rolls including an entry roll about which said strip is wrapped for applying a wrap force to said strip;

said strip having a yield strength;

said strip further having a maximum strip tension exerted thereon;

said wrap force partially determining said maximum strip tension;

said yield strength and said maximum strip tension determining a maximum attainable strip reduction; and means for creating a first differential friction force between at least said adjacent rolls of a most downstream one of said roll bites, but not between said adjacent rolls of at least one other of said roll bites, for causing a reduction in said maximum strip tension, an increase in said maximum attainable reduction per pass and a reduction in said forward tension so that the size of said forward tension providing means can be minimized, said differential friction force creating means comprising one of said adjacent rolls forming said most downstream roll bite having a first roughened surface.

40. The apparatus of claim 39 further comprising:

means for applying a separating force to obtain said strip reduction; and means for creating a second differential friction force between adjacent rolls of a most upstream one of said roll bites, said second differential friction force creating means comprising one of said adjacent rolls forming said most upstream roll bite having a second roughened surface, wherein said differential friction force creating means cause an increase in said strip tension at all of said roll bites and a reduction in the separating force required for a given strip reduction without an increase in said maximum strip tension.

41. A process for rolling metal or metal alloy strip and reducing strip thickness comprising:

providing a four-high rolling mill having a plurality of adjacent rolls between which said strip passes and means for applying forward tension to said strip;

wrapping said strip about an entry one of said rolls and applying a wrap force to said strip;

applying a forward tension to said strip with said forward tension applying means;

passing said strip between said adjacent rolls for causing a reduction in said strip thickness at each of said roll bites per pass through said mill;

said strip having a yield strength;

said strip having a maximum strip tension exerted thereon, said yield strength and said maximum strip tension determining a maximum attainable strip reduction;

creating a first differential friction force between at least said adjacent rolls of a most downstream one of said roll bites, but not between said adjacent rolls of at least one other of said roll bites, for causing a reduction in said maximum strip tension, an increase in said maximum attainable reduction per pass and a reduction in said forward tension so that the size of said forward tension applying means can be minimized; and said step of creating a first differential friction force comprising providing one of said rolls of said most downstream roll bite with a first roughened surface and contacting said strip with said first roughened surface.

42. The process of claim 41 further comprising:

applying a separating force to obtain said strip reduction; and creating a second differential force between adjacent rolls of a most upstream one of said roll bites by providing one of said rolls of said most upstream roll bite with a second roughened surface and contacting said strip with said second roughened surface, wherein said differential friction force creating means cause an increase in said strip tension at all of said roll bites and a reduction in the separating force required for a given strip reduction without an increase in said maximum strip tension.

* * * * *